United States Patent [19]

Matsui

[11] 4,380,921

[45] Apr. 26, 1983

[54] ROLL LEVELLER

[75] Inventor: Makoto Matsui, Shiroyama, Japan

[73] Assignee: Aida Engineering Ltd., Sagamihara, Japan

[21] Appl. No.: 203,886

[22] Filed: Nov. 4, 1980

[30] Foreign Application Priority Data

Nov. 22, 1979 [JP] Japan ..... 54-150596
May 6, 1980 [JP] Japan ..... 55-60681[U]

[51] Int. Cl.[3] ..... B21D 1/02; B21D 3/02

[52] U.S. Cl. ..... 72/165; 72/163; 72/160

[58] Field of Search ..... 72/163–165, 72/160, 248, 240, 243, 473, 161, 162, 250; 269/239, 126

[56] References Cited

U.S. PATENT DOCUMENTS

| | | | |
|---|---|---|---|
| 2,353,375 | 7/1944 | Todd | 72/161 |
| 2,491,782 | 12/1949 | Talbot | 72/163 |
| 2,742,949 | 4/1956 | Nilsson | 72/165 |
| 3,301,031 | 1/1967 | Bearer | 72/164 |
| 3,605,471 | 9/1971 | Bodtke | 72/165 |
| 3,798,947 | 3/1974 | Anderson et al. | 72/165 |
| 3,955,391 | 5/1976 | Wilson | 72/240 |
| 4,129,292 | 12/1978 | Pohto et al. | 269/126 |
| 4,152,913 | 5/1979 | Zerhoch et al. | 72/165 |

FOREIGN PATENT DOCUMENTS

| | | | |
|---|---|---|---|
| 529198 | 7/1931 | Fed. Rep. of Germany | 72/165 |
| 47811 | 11/1978 | U.S.S.R. | 72/163 |

*Primary Examiner*—Daniel C. Crane
*Attorney, Agent, or Firm*—Wenderoth, Lind & Ponack

[57] ABSTRACT

A roll leveller having a frame, a plurality of parallel lower rolls rotatably mounted on the frame and positioned side by side in the direction in which a material to be levelled is fed, a bracket having a plurality of parallel upper rolls rotatably mounted thereon in spaced opposed relationship to the rolls on the frame, an adjustable stop mounted thereon in spaced opposed relationship to the rolls on the frame, an adjustable stop mounted on one end of the frame for movement toward and away from the bracket and engaged by the corresponding end of the bracket, an adjustable connecting shaft pivotally connected to the other end of the bracket and mounted on the other end of the frame for movement toward and away from the bracket, a rod connected to the bracket adjacent the stop and extending away from the stop; and a pneumatic piston-cylinder device connected to the rod for moving the rod and the bracket away from the stop by pivoting movement around the pivotal connection of the other end of the bracket to the connecting shaft.

8 Claims, 8 Drawing Figures

ROLL LEVELLER

This invention relates to a roll leveller used in connection with a press, and more specifically relates to a releasing device for such a roll leveller.

BACKGROUND OF THE INVENTION AND PRIOR ART

A roll leveller is a device for uncoiling and smoothing out coiled materials to be fed to a press. The most popular and effective method of supplying such coiled materials to a press is by the use of such a roll feeder.

Where the press is a transfer type press having a plurality of metal molds, the supplied material has to be aligned in the right position. Therefore, each metal mold is provided with a pilot punch which operates to lift the feed roll of a roll feeder slightly above the material being fed so as to allow free movement of the material for a predetermined period of time.

The above operation is called the releasing of the roll feeder and a releasing device which temporarily releases the contact of the feed roll with the material is provided for all types of roll feeders. Since the roll leveller is provided at a position close to the roll feeder, when the feed roll of the roll feeder is released, the work rolls of the roll leveller should also be released simultaneously in order to permit the material to move freely.

The work rollers of the prior art roll levellers are released by the operation of hydraulic cylinders provided for each roll of the groups of work rolls. Since the releasing movement of this type tends to take some time, it is difficult to increase the rate of operation of the press or the number of operations of the slide per unit time, thus making it difficult to increase productivity.

OBJECTS OF THE INVENTION

An object of this invention is to provide a device where all work roll groups are attached to a single bracket which is moved for the releasing operation so as to synchronize the releasing of each work roll.

Another object of this invention is to provide a device which can release the work rolls at a higher speed by providing a diaphragm on a rod extending from one end of the bracket on which the work rolls in a group are mounted and by operating said diaphragm with pneumatic pressure to move the bracket.

Still another object of this invention is to provide a device wherein the space between the two opposing rows of the work rolls can be adjusted for the thickness of the material being levelled by making the position of the bracket adjustable.

BRIEF DESCRIPTION OF THE DRAWINGS

Other and further objects of the invention will become apparent from the following description taken with the accompanying drawings, in which.

Among the different types of apparatus used to uncoil and supply coiled materials to a press, there are known a coil cradle type and an uncoiler type. The former carries the coiled material on a freely rotatable roller and pulls the material from the coil when needed, while the latter fixes the core of the coiled material on a revolving mechanism and uncoils desired lengths of the material by revolving the mechanism. The former type is suitable for coiled material which has a relatively light weight while the latter is more suitable for material which has a heavy weight.

Figure 1:
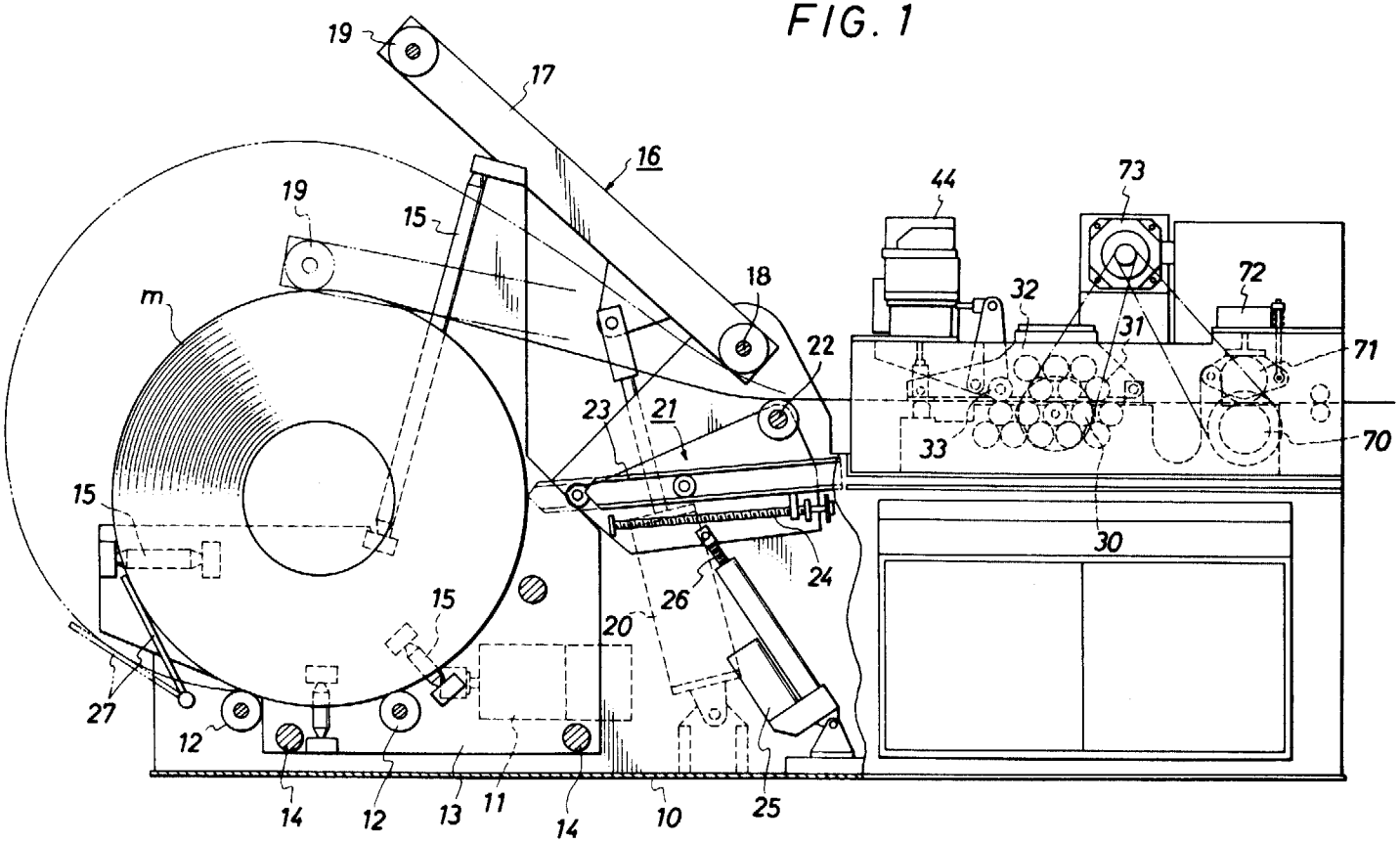
FIG. 1 is a side view showing the apparatus in which the coiled material mounted on a coil cradle is being supplied to the press via a roll leveller according to the present invention.

The roll leveller of this invention can be utilized with either the coil cradle type apparatus or the uncoiler type apparatus to level the uncoiled material. FIG. 1 shows an embodiment using a leveller according to the present invention wherein a coil cradle is combined with the leveller. In the figure, on a body 10 there is provided a motor 11 for the coil cradle which is connected via a chain (not shown) to two rolls 12 supported rotatably on the body 10. The motor 11 is driven to rotate the rolls 12 so as to rotate the coiled material m carried thereon and thereby to uncoil the material.

Side plates 13 are mounted on the the body 10 on supporting shafts 14 so as to be movable in the axial direction of the shafts, the space between the side plates 13 being adjustable. Guide rolls 15 are mounted on the inside surfaces of the side plates 13 in a freely movable fashion so that the guide rolls 15 can guide the side face of the coil m carried on the rolls 12 and restrict movement of the coil m.

The body 10 is provided with a coil press means 16 to press the coil m and which is adapted to hold the coil temporarily so that the coiled material will not be uncoiled immediately when a holding strap is removed from the coil carried on the rolls 12. One end of an arm 17 on the coil press means 16 is supported on a support shaft 18 on the body 10. The other end of the arm 17 is positioned above the rolls 12 and a roller 19 is provided on the tip end thereof. A piston cylinder mechanism 20 is connected between the body 10 and the arm 17 to move the arm 17 around the supporting shaft 18.

Since the material which has been coiled is curved in a spiral form when unwound, an opener 21 is provided on the body 10 so as to guide the tip of the coil m smoothly into the leveller. The opener 21 is mounted on the body 10 on a supporting shaft 22 in a freely movable manner and has a guide plate 23 which is extendable toward the coil carried on the rolls 12. The guide plate 23 is engaged with a threaded rod 24 which is provided parallel to the guide plate so that the position of the guide plate 23 can be adjusted in the direction of the length thereof by rotating the threaded rod 24. In order to change the angle of the opener 21, a motor for driving the opener 25 is provided between the body 10 and the opener 21. The opener 21 is provided with a threaded shaft 26 having a structure capable of extension and retraction when rotated by the motor 25.

In order to prevent the mass of the coil from disturbing the feeding movement of the feeder, uncoiled material is formed into a loop before entering the feeder. A detecting means 27 is mounted on the body 10 in order to control the size of the loop. The detecting means 27 contacts the outer side of the loop coming off the outer layer of the coiled material to detect the size of the loop. By using the angle of inclination thus detected and by turning a switch on or off, the means 27 controls the starting and the stopping of the motor 11 for driving the coil cradle. The loop is formed above the coil.

The device is operated in the following manner. The coil press means 16 is first lowered onto the coil m carried on the rolls 12 of the coil cradle with the holding strap still therearound to prevent the coil from being spontaneously uncoiled. Then when the coil is securely held by the coil press means 16, the holding strap 16 is released. The guide plate 23 of the opener 21 is brought into contact with the coil and the motor 11 is driven to rotate the rolls 2 to rotate the coil. When the coil is rotated, the tip end of the coil is uncoiled along the guide plate 23 of the opener 21 and is guided into the leveller adjacent thereto. Since when the tip end of the coil m is inserted into the pinch rolls in the leveller, the coil is not moved reversely, the coil press 16 and the opener 21 now can be removed from the coil. Then, the rolls 12 are rotated slightly more to cause the coil to form a loop.

Adjacent to the coil cradle, there is provided a roll leveller, the subject of the present invention. In the device shown in the figure, because the roll feeder is provided adjacent to the roll leveller, the overall apparatus can be called a leveller-feeder.

Figure 2:
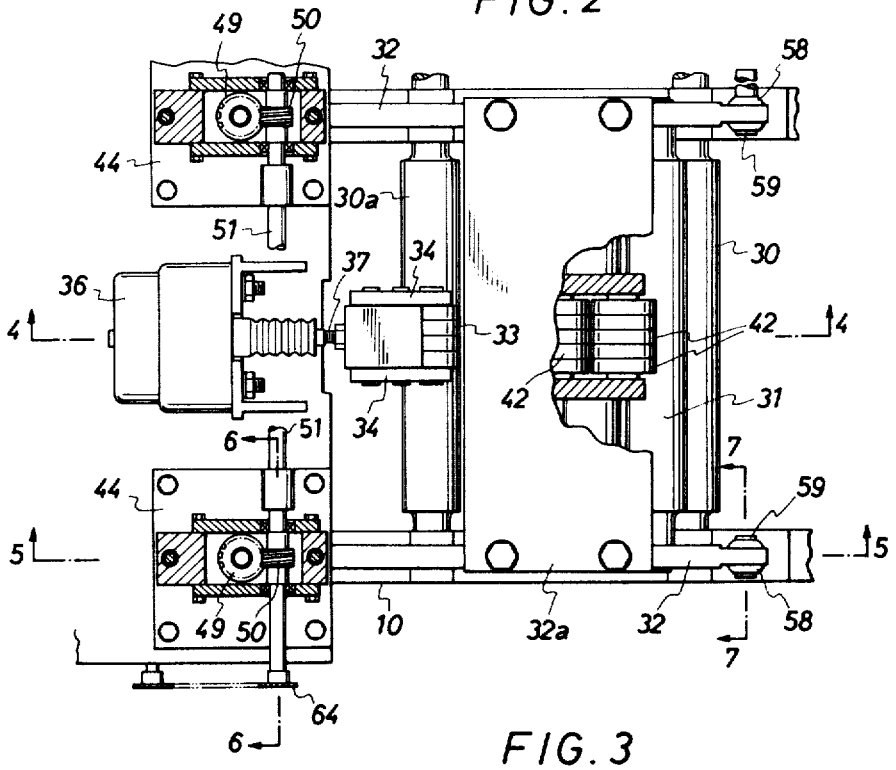
FIG. 2 is a plan view, partially sectioned, showing the roll leveller according to the present invention.
Figure 4:
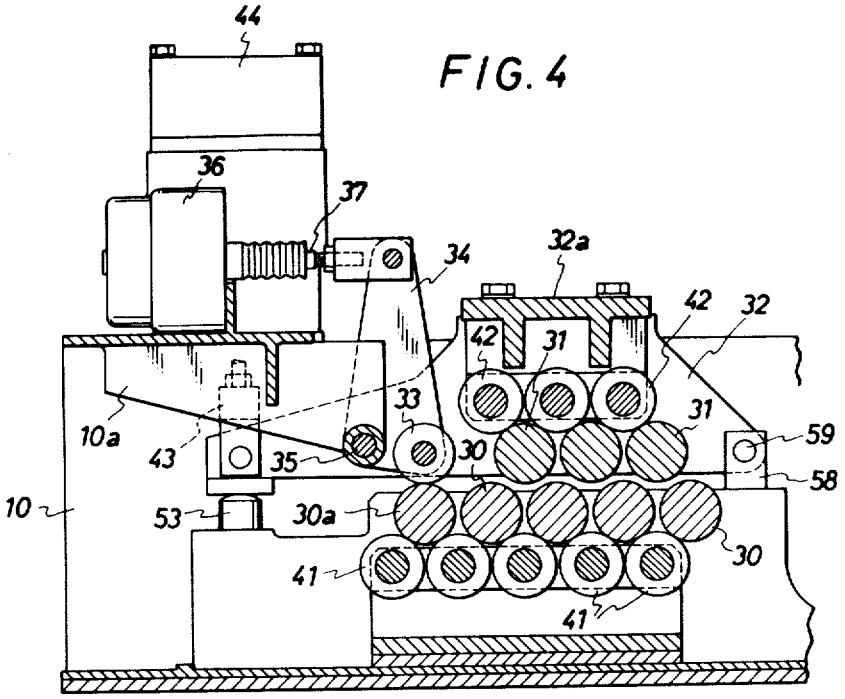
FIG. 4 is a cross sectional view taken along line 4—4 of FIG. 2.

Work rolls are in two roller groups arranged in two parallel rows, the lower rolls 30 of which are mounted rotatably on the body 10 and the upper rolls 31 of which are rotatably mounted on bracket means constituted by two parallel brackets 32. An upper pinch roll 33 is mounted on the lever 34 in a rotatable fashion as illustrated in FIG. 2 at a place adjacent to the upper rolls 31 and on the end where the coiled material enters the roller groups. The lever 34 is rotatably attached to the projection 10*a* on the body 10 by a supporting point shaft 35 as illustrated in FIG. 4. One end of the lever 34 is connected to a piston rod 37 of the piston-cylinder mechanism 36 fixed on the body 10 so that the cylinder mechanism 36 can rotate the lever 34. The upper pinch roll 33 and the lower pinch roll 30*a* which corresponds to the said pinch roll 33 among the lower rolls 30 are adapted to hold the coiled material therebetween while the material is fed to the press so as not to cause the material to reverse its course even when the leveller and the roll feeder are released.

Figure 3:
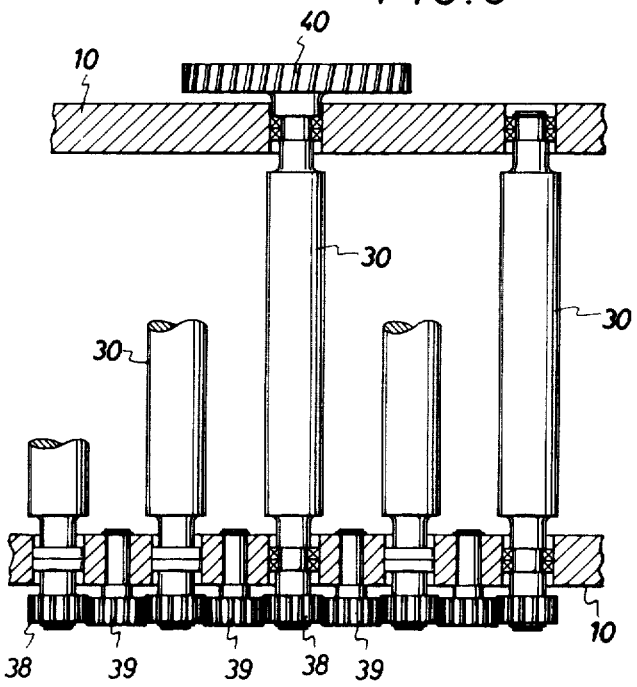
FIG. 3 is a plan view, partially sectioned, of the lower work rolls of the roll leveller.

The rotational axes of the lower work rolls 30 and the upper work rolls 31 are arranged in a staggered fashion. Referring now to FIG. 3, gears 38 are mounted on the ends of the shafts of the lower rolls 30 which project through the body 10 and intermediate gears 39 are engaged between the adjacent gears 38. One of the mounting shafts of the lower rolls projects from the other side of the body 10 and has a driving gear 40 mounted thereon. By turning the driving gear 40, the roll 30 is rotated, simultaneously rotating all of the lower rolls 30 in the same direction through the gears 38 and the intermediate gears 39.

Freely rotatable press rolls 41, or back-up rolls as they are sometimes called, are provided underneath the said lower rolls 30 between the adjacent lower rolls in order to prevent the lower rolls from warping during the smoothing-out operation and to secure such correction on the material.

The two brackets 32 support the said upper rolls 31 at both ends thereof to permit the respective rolls to rotate freely, and the upper ends of the brackets are connected to each other by an upper plate 32*a*. Press rolls 42 are also provided between respective adjacent rolls of the upper rolls 31 for prevention of warping thereof. The length of the said two press rolls 41 in the direction of the width of the apparatus may be small because each is meant to prevent warp in the central portions of the rolls 30. The upper rolls 31 do not have to have special driving means.

Each bracket 32 has a rod 43 extending upward from the end where the coiled material is supplied and which is pivotally mounted thereon and the other end of which is connected to a cylinder mechanism 44 provided on the body 10. The cylinder mechanism 44 has an open lower end across which a diaphragm 45 is mounted. The diaphragm 45 is fixed to the spring 46 provided between the diaphragm 45 and the body 10. A threaded rod 48 projects from the piston 47 slidable in the cylinder mechanism 44 in a direction away from the diaphragm and is threadedly engaged with a helical gear 49 the axial movement of which is restricted. The helical gear 49 is engaged with another helical gear 50 which is supported on a shaft 51 and which is operable from outside the cylinder mechanism as illustrated in FIG. 2.

The space between the diaphragm 45 and the piston 47 is an air chamber into which compressed air is supplied from an air supply port 52. When the compressed air is exhausted from the chamber, the diaphragm is urged toward the piston 47 by the spring 46, thereby pulling the bracket 32 upward via the rod 43.

Figure 5:
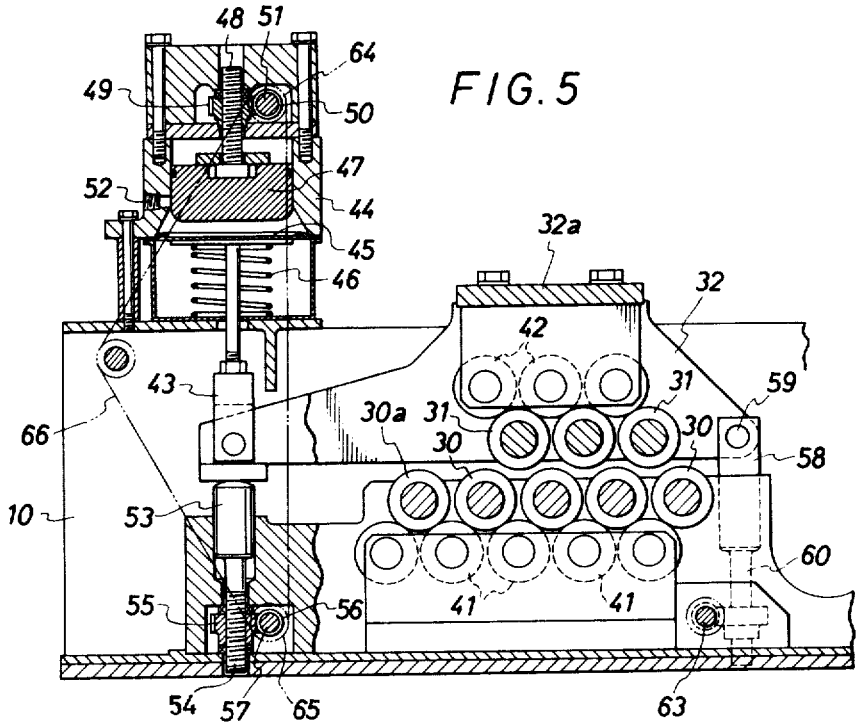
FIG. 5 is a cross sectional view taken along line 5—5 of FIG. 2.
Figure 6:
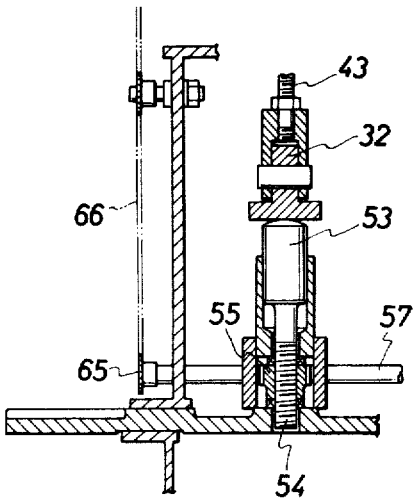
FIG. 6 is a cross sectional view taken along line 6—6 of FIG. 2.

Each bracket 32 is normally engaged with a stop means in the form of a stop 53 immediately beneath the position of the rod 43, which stop is supported in a portion of the body in a manner so as to be movable in the vertical direction as illustrated in FIG. 5. The stop 53 has a threaded rod 54 at the lower end thereof with which a helical gear 55 having the same function as the gear 49 engaged with the rod on the said piston 47 is engaged. The gear 55 is further engaged with another helical gear 56 which is operable from outside of the body by the shaft 57 as best illustrated in FIG. 6.

Figure 7:
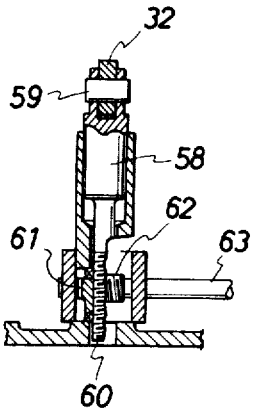
FIG. 7 is a cross sectional view taken along line 7—7 of FIG. 2.

Referring to FIGS. 5 and 7 on the other end of each bracket 32 is a connecting shaft means in the form of a connecting shaft 58 pivotably mounted on a pin 59 on the bracket, the height thereof being adjustable by external operation. The lower end of the connecting rod 58 has a threaded rod 60 with a helical gear 61 thereon, which in turn is engaged with a helical gear on the shaft 63.

As described in the foregoing, both brackets 32 have a cylinder mechanism 44 and a stop 53. The shafts 51, 57 and 63 carry the helical gears 50, 56 and 62 for the mechanisms of each bracket and are operatively connected so that the operation of the cylinder mechanisms 44 and the stops 53 and the connecting shafts 58 are synchronized. The shafts 51 and 57 of the helical gears 50 and 56 of the cylinder mechanism 44 and the stop 53 are provided with chain sprockets 64 and 65 and a chain 66 extends around the sprockets so that the piston heights of the stop 53 and the cylinder mechanism 44 can be adjusted together as illustrated in FIG. 5.

Feeder rolls 70 and 71 are provided adjacent to the leveller as illustrated in FIG. 1. The coiled material is supplied by the feeding rolls 70 and 71 to the press after passing through the leveller. The lower roll 70 is for driving the material and the upper roll 71 is movable in the vertical direction by a clamp cylinder 72. The reference numeral 73 denotes a motor to drive the work rolls and the feeder rolls 70 and 71 to the press after passing through the leveller.

The brackets 32 on which the upper rolls 31 of the work rolls are mounted are rotatable around the pins 59 on the connecting shafts 58. Therefore, when the compressed air is exhausted from the air chambers of the cylinder mechanisms 44, the diaphragms 45 are urged toward the pistons 47 by the springs 46, thereby rotating the brackets 32 around the pins 59 through the rods 43 to separate the lower rolls 30 and the upper rolls 31 from each other. This operation is called the release of the work rolls and this should be conducted synchronously with the operation of said feeder rolls 70 and 71 when the coiled material is supplied by the feeder rolls to the metal molds of the press.

When the thickness of the coil material to be supplied is changed, the clearance between the upper rolls 31 and lower rolls 30 can be adjusted by changing the position of the brackets 32 by raising the stop 53 and the connecting shafts 58. The height of the pistons 47 in the cylinder mechanisms is adjusted simultaneously thereto so that the releasing is conveniently at a predetermined timing irrespective of the thickness of the coil.

Figure 8:
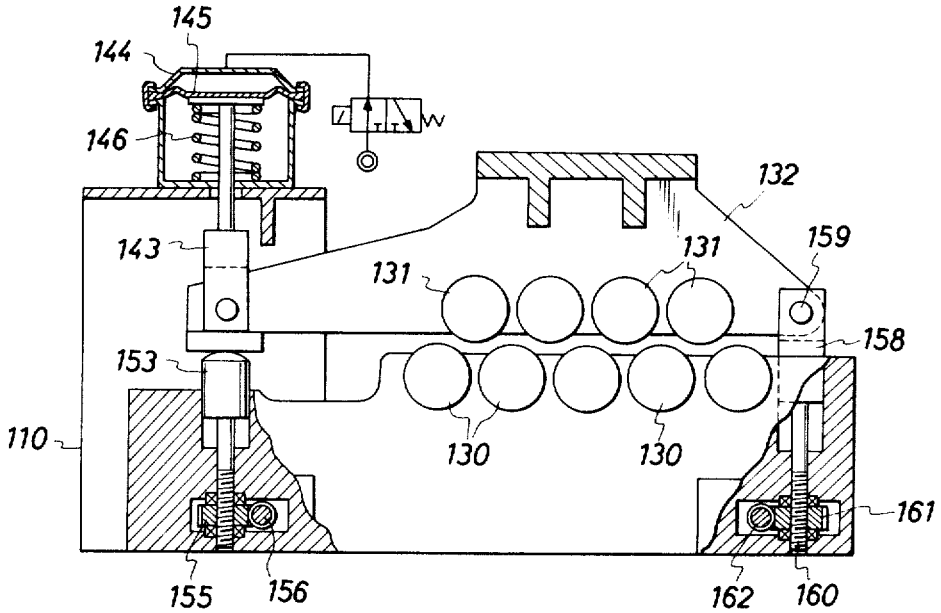
FIG. 8 is a sectional side view showing another embodiment of a roll leveller according to the present invention.

Another embodiment of this invention is shown in FIG. 8 wherein the volume of the air chamber formed by the diaphragm is not controlled synchronously with the operation to change the position of the bracket.

The reference numerals shown in the figure for the second embodiment are three digit numerals and the lower two digits denote the parts common to the first embodiment described by the identical numbers in the foregoing.

In this embodiment, worm gears 155, 156, 161 and 162 are used in place of the helical gears as means to move the stops 152 and the connecting shafts 158 in a vertical direction. This shows that the helical gear can be replaced by a worm gear in the first embodiment also.

What is claimed is:

1. A roll leveller comprising:

a frame having a first and a second end;

a plurality of parallel lower rolls rotatably mounted on said frame and positioned side by side in the direction in which a material to be levelled is fed by said roll leveller, said lower rolls being adapted to be driven;

a plurality of parallel upper rolls;

a bracket means having third and fourth ends respectively corresponding to said first and second ends of said frame, said plurality of parallel upper rolls being rotatably mounted thereon in spaced opposed relationship to said lower rolls;

a stop means mounted on said first end of said frame for movement toward and away from said bracket means and engaged by said third end of said bracket means;

a connecting shaft means pivotally connected to said fourth end of said bracket means and mounted on said second end of said frame for movement toward and away from said frame so as to effect changes in spacing between said upper rolls and said lower rolls;

a rod means connected to said bracket means adjacent said stop means and extending away from said stop means; and a piston-cylinder means, mounted on said frame and connected to said rod means, for moving said rod means and said bracket means away from said stop means by pivoting movement around the pivotal connection of said fourth end of said bracket means to said connecting shaft means.

2. A roll leveller as claimed in claim 1 in which said bracket means comprises a pair of parallel brackets, and said stop means comprises a stop for each of said pair of brackets, said connecting shaft means comprises an axially movable connecting shaft for each of said pair of brackets, and said rod means comprises a rod on each of said pair of brackets.

3. A roll leveller as claimed in claim 1 in which said piston-cylinder means comprises a pneumatic piston-cylinder means having a cylinder with an open end, a piston adjustably mounted in said cylinder, a diaphragm across the open end of said cylinder normally spaced from said piston, spring means for urging said diaphragm away from said stop means, and means for releasing the pneumatic pressure betwen said diaphragm and said piston, said rod means being connected to said diaphragm for moving said diaphragm away from said stop means when the pneumatic pressure between said diaphragm and said piston is released.

4. A roll leveller as claimed in claim 3 in which said stop means is connected to said piston for moving said piston to maintain the volume of the space between said piston and said diaphragm when said stop means is moved relative to said bracket means.

5. A roll leveller as claimed in claim 1, further comprising first and second adjusting means respectively connected to said stop means and said connecting shaft means, for adjustably moving said stop means and said connecting shaft means toward and away from said bracket means, and adjustment connection means for connecting said first and second adjusting means such that the adjusting movement of said stop means and said connecting shaft means are carried out in synchronization.

6. A roll leveller as claimed in claim 5 in which said first and second adjusting means comprise rotatable threaded shafts, said stop means and said connecting shaft means having threaded portions engaged with said threaded shafts for being moved toward and away from said bracket means by rotation of said threaded shafts of said first and second adjusting means.

7. A roll leveller as claimed in claim 1 in which said piston-cylinder means comprises a pneumatic piston-cylinder means having a cylinder with an open end, a piston adjustably mounted in said cylinder, a diaphragm across the open end of said cylinder normally spaced from said piston, spring means for urging said diaphragm away from said stop means, means for releasing the pneumatic pressure between said diaphragm and said piston, said rod means being connected to said diaphragm for moving said diaphragm away from said stop means when the pneumatic pressure between said diaphragm and said piston is released, first and second adjusting means respectively connected to said stop means and said connecting shaft means for adjustably moving said stop means and said connecting shaft means toward and away from said bracket means, and adjustment connection means for connecting said first and second adjusting means to each other and to said piston of said piston-cylinder means for carrying out adjusting movement of said stop means and said connecting shaft means in synchronization and simultaneously adjustably moving said piston for maintaining the volume of space between said piston and diaphragm when said stop means and connecting shaft means are moved.

8. A roll leveller as claimed in claim 7 in which said adjusting means comprises first threaded shafts at least one of which has a first sprocket thereon, said stop means and said connecting shaft means having threaded portions engaged with said first threaded shafts for being moved toward and away from said bracket means by rotation of said first threaded shafts, and said piston-cylinder means having a further threaded shaft with a second sprocket thereon, said piston having an other threaded shaft attached thereto and engaged with said further threaded shaft, said leveller further comprising a chain extending around said first and said second sprockets, connecting said further threaded shaft and at least one of said first threaded shafts.

* * * * *